US010641535B2

(12) United States Patent
Murgham et al.

(10) Patent No.: US 10,641,535 B2
(45) Date of Patent: May 5, 2020

(54) ICE MAKER AND METHOD OF MAKING AND HARVESTING ICE

(71) Applicant: Emerson Climate Technologies, Inc., Sidney, OH (US)

(72) Inventors: Haithem Murgham, Beavercreek, OH (US); David Myszka, Dayton, OH (US); Kyaw Wynn, Sidney, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 102 days.

(21) Appl. No.: 15/924,824

(22) Filed: Mar. 19, 2018

(65) Prior Publication Data

US 2019/0285327 A1 Sep. 19, 2019

(51) Int. Cl.

| | |
|---|---|
| ***F25C 5/10*** | (2006.01) |
| ***F25C 1/12*** | (2006.01) |
| ***F25C 1/25*** | (2018.01) |

(52) U.S. Cl.

CPC ..... *F25C 5/10* (2013.01); *F25C 1/12* (2013.01); *F25C 1/25* (2018.01)

(58) Field of Classification Search

CPC ..... F25C 5/10; F25C 1/25; F25C 1/12
USPC ..... 62/135
See application file for complete search history.

(56) References Cited

U.S. PATENT DOCUMENTS 3,430,452 A 3/1969 Dedricks et al.
4,791,792 A * 12/1988 Naruse ..... F25C 5/10 62/135
6,205,807 B1 3/2001 Broadbent
6,647,739 B1 11/2003 Kim et al.
6,681,580 B2 1/2004 Shedivy et al.
(Continued)

FOREIGN PATENT DOCUMENTS

CN 101403540 A 4/2009
CN 101929773 A 12/2010
(Continued)

OTHER PUBLICATIONS

Restriction Requirement regarding U.S. Appl. No. 15/375,614, dated Sep. 6, 2018.
(Continued)

*Primary Examiner* — Ana M Vazquez
(74) *Attorney, Agent, or Firm* — Harness, Dickey & Pierce, P.L.C.

(57) ABSTRACT

An ice-maker system may be operable in an ice-making mode and in an ice-harvesting mode and may include a working-fluid circuit and an ice mold. The working-fluid circuit may include a compressor, an expansion device, and an ice-making heat exchanger. The expansion device is disposed downstream of the compressor. The ice-making heat exchanger is disposed between the expansion device and the compressor along the working-fluid circuit. The ice mold includes a plurality of pockets configured to receive water from a water-supply conduit when the system is operating in the ice-making mode. The ice mold may be in a heat-transfer relationship with the ice-making heat exchanger. The ice mold may define a channel that receives a warming fluid from a warming-fluid-supply conduit when the system is operating in the ice-harvesting mode. The warming fluid is fluidly isolated from working fluid circulating through the working-fluid circuit.

27 Claims, 3 Drawing Sheets

(56) References Cited

U.S. PATENT DOCUMENTS

| | | | | |
|---|---|---|---|---|
| 2002/0095944 | A1 | 7/2002 | Stensrud et al. | |
| 2004/0244398 | A1 | 12/2004 | Radermacher et al. | |
| 2005/0028549 | A1 | 2/2005 | Kuroyanagi | |
| 2009/0001866 | A1 | 1/2009 | Kaga et al. | |
| 2009/0288445 | A1 | 11/2009 | Anikhindi et al. | |
| 2010/0147005 | A1 | 6/2010 | Watson et al. | |
| 2010/0218519 | A1 | 9/2010 | Hall et al. | |
| 2011/0314848 | A1* | 12/2011 | Tanaka | F25B 13/00 62/126 |
| 2012/0222434 | A1 | 9/2012 | Gist et al. | |
| 2014/0209125 | A1 | 7/2014 | Broadbent | |
| 2017/0176079 | A1 | 6/2017 | Bahel et al. | |

FOREIGN PATENT DOCUMENTS

| | | | |
|---|---|---|---|
| CN | 102066856 | A | 5/2011 |
| CN | 102345953 | A | 2/2012 |
| EP | 0708300 | A1 | 4/1996 |
| JP | H06064576 | U | 4/1991 |
| JP | 2006023068 | A | 1/2006 |
| JP | 2009145017 | A | 7/2009 |
| KR | 2019890016569 | U | 8/1989 |
| KR | 101461802 | B1 | 11/2014 |

OTHER PUBLICATIONS

Office Action regarding Chinese Patent Application No. 201611159751.3, dated Dec. 25, 2018. Translation provided by Unitalen Attorneys at Law.

Office Action regarding U.S. Appl. No. 15/375,614, dated Jan. 24, 2019.

AHRI Standard 540, 2015 Standard for Performance Rating of Positive Displacement Refrigerant Compressors and Compressor Units, Air-Conditioning, Heating, & Refrigeration Institute, 23 Pages.

Akhilesh Arora, S.C. Kaushik, Theoretical analysis of a vapour compression refrigeration system with R502, R404A and R507A, International Journal of Refrigeration 31 (2008), pp. 998-1005.

ANSI/AHRI Standard 210/240, 2008 Standard for Performance Rating of Unitary Air-Conditioning & Air-Source Heat Pump Equipment, Air-Conditioning, Heating, and Refrigeration Institute, pp. 21-34.

ARI Standard 810, 2007 Standard for Performance Rating of Automatic Commercial Ict-Makers, Air-Conditioning and Refrigeration Institute, 9 Pages.

Bin Li, Andrew G. Alleyne, A dynamic model of a vapor compression cycle with shut-down and start-up operations, International Journal of Refrigeration 33 (2010), pp. 538-552.

Chi-Chuan Wang, Kuan-Yu Chi, Heat transfer and friction characteristics of plain fin-and-tube heat exchangers, part I: new experimental data, International Journal of Heat and Mass Transfer 43 (2000), pp. 2681-2691.

Christopher Laughman, Yiming Zhao, Daniel Nikovski, Fast Refrigerant Property Calculations Using Interpolation-Based Methods (2012), International Refrigeration and Air Conditioning Conference, Paper 1344, Pursue University, 11 Pages.

Detlef Westphalen et al., Energy Savings Potential for Commercial Refrigeration Equipment, U.S. Department of Energy, Jun. 1996, pp. 39-49.

Dr. A.E. Dabiri, C.K, Rice, A Compressor Simulation Model With Corrections for the Level of Suction Gas Superheat, Ashrae Transactions 1981, V. 87, Pt. 2, 12 Pages.

Hongtao Qiao, Vikrant Aute, Reinhard Radermacher, Comparison of Equation-Based and Non-Equation-Based Approaches for Transient Modeling of a Vapor Compression Cycle, International Refrigeration and Air Conditioning Conference at Purdue, Jul. 16-19, 2012, 10 Pages.

J. Chi, D. Didion, A simulation model of the transient performance of a heat pump, 1982, International Journal of Refrigeration, 9 Pages.

J.W. MacArthur, Transient heat pump behaviour: a theoretical investigation, 1984 Butterworth & Co. (Publishers) Ltd and IIR, vol. 7 No. 2 Mar. 1984, pp. 123-132.

K. A. James, R.W. James, Transient analysis of thermostatic expansion valves for refrigeration system evaporators using mathematical models, Institute of Environmental Engineering, South Bank Polytechnic, London, Trans Inst M C vol. 9, No. 4, Oct.-Dec. 1987, 8 Pages.

N. Hoffenbecker, S.A. Klein, D.T. Reindl, Hot gas defrost model development and validation, International Journal of Refrigeration 28 (2005), pp. 605-615.

Piotr Domanski, David Didion, Computer Modeling of the Vapor Compression Cycle With Constant Flow Area Expansion Device, U.S. Department of Commerce, Issued May 1983, 160 Pages.

S.K. Fischer, C. K. Rice, a Steady-State Computer Design Model for Air-to-Air Heat Pumps, Oak Ridge National Laboratory, pp. 26-36.

Satyam Bendapudi, James E. Braun, Eckhard A. Groll, A comparison of moving-boundary and finite-volume formulations for transients in centrifugal chillers, www.elsevier.com/locate/ijrefrig, pp. 1437-1452.

SimscapeTM User's Guide, Matlab&Simulink, 2007-2016 by The MathWorks, Inc.

Varone, Appendix 5A, Energy Modeling, Freeze, 9 Pages.

Vijay Bahel, Suresh Shivashankar, Using Simulation Model to Reduce System Design Time and Cost, 15th International Refrigeration and Air Conditioning Conference at Purdue, Jul. 14-17, 2014, 9 Pages.

Wang, Jang, Chiou, Technical Note, A heat transfer and friction correlation for wavy fin-and-tube heat exchangers, International Journal of Heat and Mass Transfer 42 (1999), pp. 1919-1924.

Wang, Lee, Chang, Lin, Heat transfer and friction correlation for compact louvered fin-and-tube heat exchangers, International Journal of Heat and Mass Transfer 42 (1999), pp. 1945-1956.

Wang, Lee, Sheu, A comparative study of compact enhanced fin-and-tube heat exchangers, International Journal of Heat and Mass Transfer 44 (2001), pp. 3565-3573.

Y.T. Ge, R. Cropper, Performance evaluations of air-cooled condensers using pure and mixture refrigerants by four-section lumped modelling methods, Applied Thermal Engineering 25 (2005), pp. 1549-1564.

International Search Report regarding International Application No. PCT/US2019/019228, dated Jun. 3, 2019.

Written Opinion of the International Searching Authority regarding International Application No. PCT/US2019/019228, dated Jun. 3, 2019.

Office Action regarding Chinese Patent Application No. 201611159751.3, dated Aug. 5, 2019. Translation provided by Unitalen Attorneys at Law.

Office Action regarding U.S. Appl. No. 15/375,614, dated Aug. 19, 2019.

* cited by examiner

ICE MAKER AND METHOD OF MAKING AND HARVESTING ICE

FIELD

The present disclosure relates to an ice-making system and a method of making and harvesting ice.

BACKGROUND

This section provides background information related to the present disclosure and is not necessarily prior art.

Automatic commercial ice-making machines produce batches of ice cubes at regular intervals. Such ice machines are commonly used in food service, food preservation, hotel, and health service industries. Ice machines typically include a vapor-compression system that is operable in a freeze mode and a harvest mode. In the freeze mode, the vapor-compression system freezes water in a grid plate (i.e., an ice mold) formed on an evaporator of the vapor-compression system. In the harvest mode, the vapor-compression system melts a small amount of the ice in the ice tray so that the ice cubes can be easily ejected from the ice tray. The present disclosure provides an ice-maker system that is energy efficient and is capable of high ice-production rates.

SUMMARY

This section provides a general summary of the disclosure, and is not a comprehensive disclosure of its full scope or all of its features.

The present disclosure provides an ice-maker system operable in an ice-making mode and in an ice-harvesting mode. The system may include a working-fluid circuit (e.g., a vapor-compression system) and an ice mold. A working fluid flows through the working-fluid circuit. The working-fluid circuit may include a compressor, an expansion device, and an ice-making heat exchanger. The expansion device is disposed downstream of the compressor. The ice-making heat exchanger is disposed between the expansion device and the compressor along the working-fluid circuit. The ice mold may include a plurality of pockets configured to receive water from a water-supply conduit when the system is operating in the ice-making mode. The ice mold may be in a heat-transfer relationship with the ice-making heat exchanger. The ice mold may define a channel configured to receive warming fluid from a warming-fluid-supply conduit when the system is operating in the ice-harvesting mode. The warming fluid from the warming-fluid-supply conduit has a higher temperature than the water from the water-supply conduit. The warming fluid may be fluidly isolated from the working fluid that circulates through the working-fluid circuit. The warming fluid may be a different substance than the working fluid.

In some configurations, the system includes a warming-fluid tank and a warming-fluid-return conduit. The warming-fluid tank may be in fluid communication with the warming-fluid-supply conduit. The warming-fluid-return conduit may be in fluid communication with the channel and the warming-fluid tank.

In some configurations, the working-fluid circuit includes a fluid-heating heat exchanger in a heat-transfer relationship with the warming fluid in the warming-fluid tank. The fluid-heating heat exchanger may be in fluid communication with the compressor such that working fluid discharged from the compressor is received in the fluid-heating heat exchanger prior to flowing to the expansion device.

In some configurations, the fluid-heating heat exchanger is disposed inside of the warming-fluid tank.

In some configurations, the system includes a pump that pumps warming fluid from the warming-fluid tank through the warming-fluid-supply conduit, the channel and the warming-fluid-return conduit. A control module may operate the pump in the ice-harvesting mode and shutdown the pump in the ice-making mode.

In some configurations, the working fluid discharged from the compressor is received in the fluid-heating heat exchanger in the ice-harvesting mode and in the ice-making mode.

In some configurations, the working-fluid circuit includes a heat exchanger (e.g., a condenser or gas cooler) that is spaced apart from the warming-fluid tank and is in fluid communication with the fluid-heating heat exchanger and the expansion device such that the heat exchanger receives working fluid from the fluid-heating heat exchanger and provides working fluid to the expansion device.

In some configurations, the system includes a cold-water tank in fluid communication with the water-supply conduit. The working-fluid circuit may include a water-cooling heat exchanger in a heat-transfer relationship with the cold-water tank. The water-cooling heat exchanger may be in fluid communication with the expansion device such that working fluid from the expansion device is received in the water-cooling heat exchanger prior to flowing to the compressor.

In some configurations, the water-cooling heat exchanger is disposed inside of the cold-water tank.

In some configurations, the working-fluid circuit includes a valve in fluid communication with the expansion device, the ice-making heat exchanger and the water-cooling heat exchanger. The valve may be movable between a first position in which the valve allows fluid flow from the expansion device to the ice-making heat exchanger and restricts fluid flow from the expansion device to the water-cooling heat exchanger and a second position in which the valve allows fluid flow from the expansion device to the water-cooling heat exchanger and restricts fluid flow from the expansion device to the ice-making heat exchanger.

In some configurations, the valve is in the first position when the system is in the ice-making mode, and the valve is in the second position when the system is in the ice-harvesting mode.

In some configurations, the compressor is a scroll compressor.

In some configurations, the warming fluid is water.

In some configurations, the warming fluid is water with an additive that raises the boiling point of the warming fluid to a temperature higher than the boiling point of water.

The present disclosure also provides an ice-maker system operable in an ice-making mode and in an ice-harvesting mode and includes a working-fluid circuit (e.g., a vapor-compression system), an ice mold, and a cold-water tank. A working fluid flows through the working-fluid circuit. The working-fluid circuit may include a compressor, an expansion device, and an ice-making heat exchanger. The expansion device is disposed downstream of the compressor. The ice-making heat exchanger is disposed between the expansion device and the compressor along the working-fluid circuit. The ice mold may include a plurality of pockets configured to receive water from a water-supply conduit when the system is operating in the ice-making mode. The ice mold is in a heat-transfer relationship with the ice-making heat exchanger. The cold-water tank may be in fluid communication with the water-supply conduit. The working-fluid circuit may include a water-cooling heat exchanger in a heat-transfer relationship with the cold-water tank. The water-cooling heat exchanger may be in fluid communication with the expansion device such that working fluid from the expansion device is received in the water-cooling heat exchanger prior to flowing to the compressor.

In some configurations, the ice mold defines a channel configured to receive warming fluid from a warming-fluid-supply conduit while the system is operating in the ice-harvesting mode. The warming fluid from the warming-fluid-supply conduit has a higher temperature than the water from the first water-supply conduit. The warming fluid is fluidly isolated from the working fluid that circulates through the working-fluid circuit.

In some configurations, the warming fluid is water.

In some configurations, the warming fluid is water with an additive that raises the boiling point of the warming fluid to a temperature higher than the boiling point of water.

In some configurations, the system includes a warming-fluid tank and a warming-fluid-return conduit. The warming-fluid tank may be in fluid communication with the warming-fluid-supply conduit. The warming-fluid-return conduit may be in fluid communication with the channel and the warming-fluid tank.

In some configurations, the working-fluid circuit includes a fluid-heating heat exchanger in a heat-transfer relationship with the warming fluid in the warming-fluid tank. The fluid-heating heat exchanger is in fluid communication with the compressor such that working fluid discharged from the compressor is received in the fluid-heating heat exchanger prior to flowing to the expansion device.

In some configurations, the fluid-heating heat exchanger is disposed inside of the warming-fluid tank.

In some configurations, the working fluid discharged from the compressor is received in the fluid-heating heat exchanger in the ice-harvesting mode and in the ice-making mode.

In some configurations, the working-fluid circuit includes a heat exchanger that is spaced apart from the warming-fluid tank and is in fluid communication with the fluid-heating heat exchanger and the expansion device such that the heat exchanger receives working fluid from the fluid-heating heat exchanger and provides working fluid to the expansion device.

In some configurations, the system includes a warming-fluid pump that pumps warming fluid from the warming-fluid tank through the warming-fluid-supply conduit, the channel and the warming-fluid-return conduit. A control module may operate the warming-fluid pump in the ice-harvesting mode and shutdown the warming-fluid pump in the ice-making mode.

In some configurations, the working-fluid circuit includes a valve in fluid communication with the expansion device, the ice-making heat exchanger and the water-cooling heat exchanger. The valve may be movable between a first position in which the valve allows fluid flow from the expansion device to the ice-making heat exchanger and restricts fluid flow from the expansion device to the water-cooling heat exchanger and a second position in which the valve allows fluid flow from the expansion device to the water-cooling heat exchanger and restricts fluid flow from the expansion device to the ice-making heat exchanger.

In some configurations, the valve is in the first position when the system is in the ice-making mode, and the valve is in the second position when the system is in the ice-harvesting mode.

In some configurations, the water-cooling heat exchanger is disposed inside of the cold-water tank.

In some configurations, the compressor is a scroll compressor.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
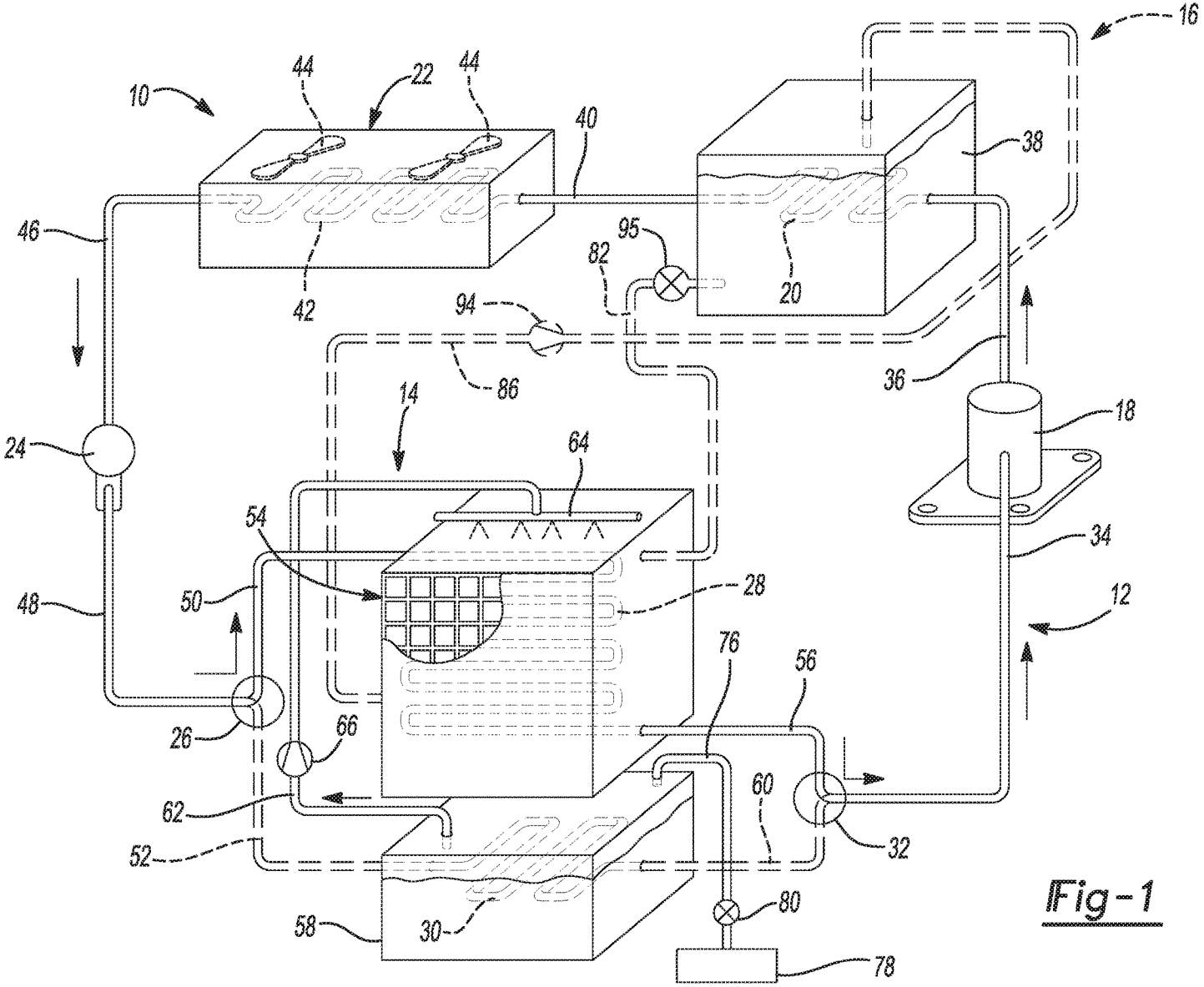
FIG. 1 is a schematic representation of an ice-maker system in an ice-making mode according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-4, an ice-maker system 10 is provided that may include a working-fluid circuit (e.g., a vapor-compression circuit) 12, a cold-water circuit 14, and a warming-fluid circuit (or hot-water circuit) 16. The system 10 is operable in an ice-making mode (shown in FIG. 1) in which the system 10 forms ice cubes and in an ice-harvesting mode (shown in FIG. 2) in which the system 10 melts a small amount of ice from the ice cubes to allow the ice cubes to fall into a collection bin (not shown). For purposes of the present disclosure, the term "ice cube" should be understood to include any volume of ice having the shape of a cube, a rectangular prism, a crescent or half-moon shape, a cylinder, a tube, or any other three-dimensional shape.

The working-fluid circuit 12 may include a compressor 18, a fluid-heating heat exchanger (or a water-heating heat exchanger) 20, a condenser heat exchanger or gas cooler heat exchanger 22, an expansion device 24, a first control valve 26, an ice-making heat exchanger 28, a water-cooling heat exchanger 30, and a second control valve 32. The compressor 18 may be a scroll compressor, for example, or any other type of compressor (e.g., a reciprocating compressor, a rotary compressor, etc.). The compressor 18 may receive a working fluid (e.g., R134a, R417a, carbon dioxide, ammonia, or any other suitable refrigerant) from a suction conduit 34. The compressor 18 may compress the working fluid from a first pressure to a higher second pressure and discharge the compressed working fluid into a discharge conduit 36.

The discharge conduit 36 may be fluidly coupled with the fluid-heating heat exchanger 20. The fluid-heating heat exchanger 20 may be a coil disposed within and/or attached to a warming-fluid tank 38 containing a volume of warming fluid. The warming fluid may be water, for example, or water with an additive (e.g., sodium chloride, propylene glycol, or other suitable additive) to increase the boiling point of the water. In some configurations, the warming fluid could be a refrigerant. Hot working fluid discharged from the compressor 18 flows through the fluid-heating heat exchanger 20 where heat is transferred from the working fluid to the warming fluid contained in the warming-fluid tank 38.

The condenser (or gas cooler) heat exchanger 22 is disposed downstream of the fluid-heating heat exchanger 20 such that working fluid flows from the fluid-heating heat exchanger 20 to the condenser (or gas cooler) heat exchanger 22 via conduit 40 connected to the fluid-heating heat exchanger 20 and the condenser (or gas cooler) heat exchanger 22. The condenser (or gas cooler) heat exchanger 22 may include a coil 42 and one or more fans 44. The coil 42 receives working fluid from the conduit 40. The fans 44 force air across the coil 42 to cool the working fluid flowing through the coil 42. In some configurations, the condenser heat exchanger 22 may be a water-cooled condenser instead of an air-cooled condenser. In some configurations, the condenser heat exchanger 22 may be made smaller than typical condensers in prior-art ice makers since, in the ice-maker system 10 of the present disclosure, the working fluid is pre-cooled in the warming-fluid tank 38 prior to flowing through the condenser heat exchanger 22.

Another conduit 46 may be coupled to the expansion device 24 and to an outlet of the coil 42 such that the conduit 46 provides working fluid from the coil 42 to the expansion device 24. The expansion device 24 may be an expansion valve (e.g., an electronic or thermal expansion device) or a capillary tube, for example. Working fluid from the conduit 46 drops in pressure as it flows through the expansion device 24. Cold, low-pressure working fluid may flow from the expansion device 24 to the first control valve 26 via a conduit 48.

Figure 2:
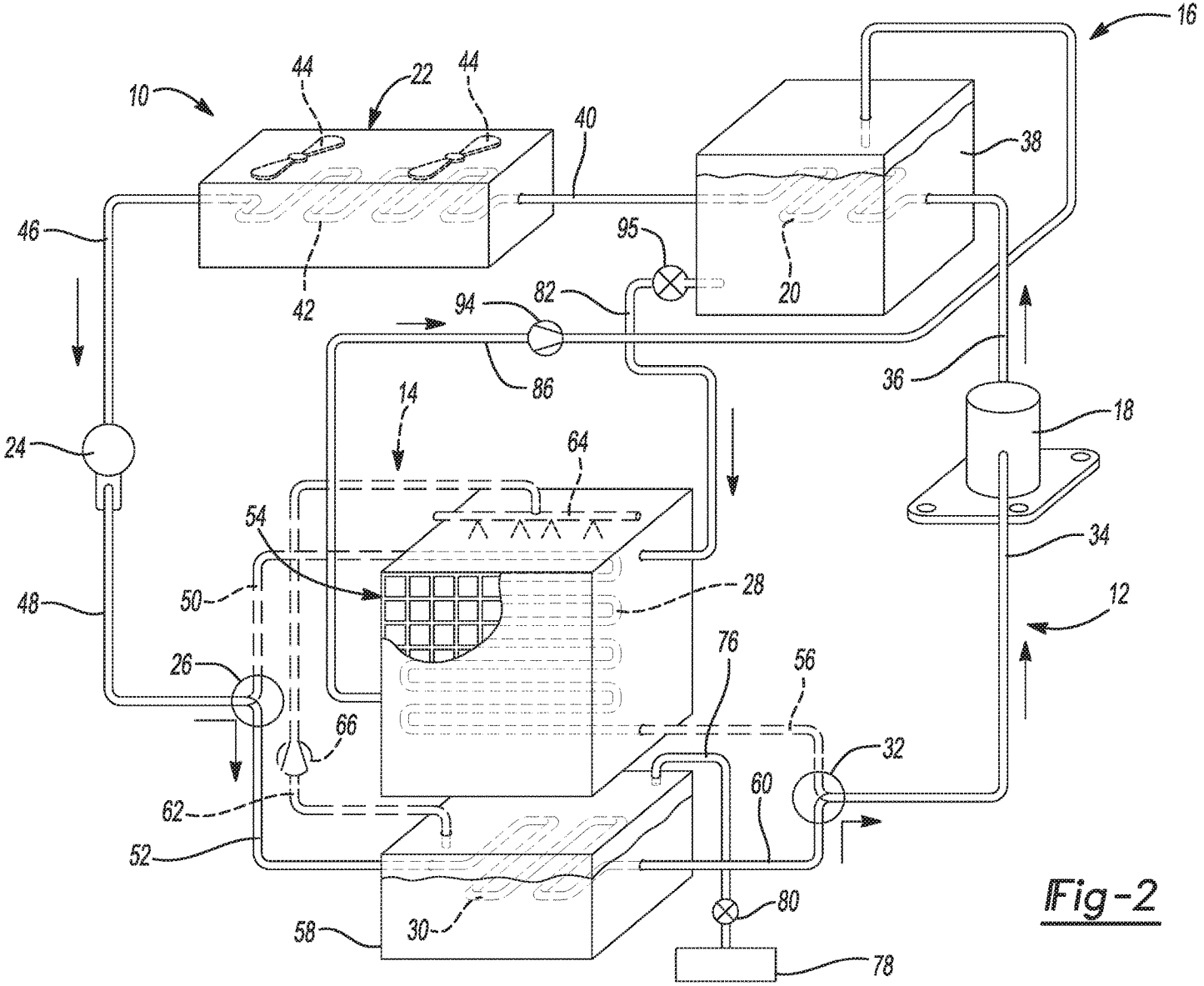
FIG. 2 is a schematic representation of an ice-maker system in an ice-harvesting mode according to the principles of the present disclosure.

The first control valve 26 may be an electronic three-way valve that may be connected to the conduit 48, a first inlet conduit 50, and a second inlet conduit 52. The first inlet conduit 50 may be fluidly connected to an inlet of the ice-making heat exchanger 28. The second inlet conduit 52 may be fluidly connected to an inlet of the water-cooling heat exchanger 30. The first control valve 26 may be movable between a first position (FIG. 1) and a second position (FIG. 2). In the first position, the first control valve 26 allows working fluid from the conduit 48 to flow through the first inlet conduit 50 and into the ice-making heat exchanger 28 and the first control valve 26 restricts or prevents working fluid from flowing into the second inlet conduit 52 and into the water-cooling heat exchanger 30. In the second position, the first control valve 26 allows working fluid from the conduit 48 to flow through the second inlet conduit 52 and into the water-cooling heat exchanger 30 and the first control valve 26 restricts or prevents working fluid from flowing into the first inlet conduit 50 and into the ice-making heat exchanger 28. A control module 53 (FIG. 4) may be in communication with the first control valve 26 and may control operation of the first control valve 26, as will be described in more detail below. In some configurations, the first control valve 26 may be movable to one or more positions between the first and second positions to allow fluid flow through both of the inlet conduits 50, 52 and both of the heat exchangers 28, 30.

The ice-making heat exchanger 28 may be a coil mounted to and/or embedded in an ice mold 54 (e.g., a mold in which ice cubes are formed). Cold working fluid flowing through the ice-making heat exchanger 28 absorbs heat from the ice mold 54 to cool and freeze water flowing over the ice mold 54. An outlet of the ice-making heat exchanger 28 may be fluidly connected to a first outlet conduit 56.

The water-cooling heat exchanger 30 may be a coil disposed within and/or attached to a cold-water tank 58 containing a volume of water. Cold working fluid flowing through the water-cooling heat exchanger 30 cools (i.e., absorbs heat from) the water in the cold-water tank 58. An outlet of the water-cooling heat exchanger 30 may be fluidly connected to a second outlet conduit 60.

The second control valve 32 may be an electronic three-way valve that may be connected to the first and second outlet conduits 56, 60 and the suction conduit 34. The second control valve 32 may be movable between a first position (FIG. 1) and a second position (FIG. 2). In the first position, the second control valve 32 allows working fluid to flow from the first outlet conduit 56 to the suction conduit 34 and restricts or prevents fluid flow into the second outlet conduit 60. In the first position, the second control valve 32 allows working fluid to flow from the second outlet conduit 60 to the suction conduit 34 and restricts or prevents fluid flow into the first outlet conduit 56. The control module 53 (FIG. 4) may be in communication with the second control valve 32 and may control operation of the second control valve 32, as will be described in more detail below. In some configurations, the second control valve 32 may be movable to one or more positions between the first and second positions to allow working fluid from both of the outlet conduits 56, 60 to flow into the suction conduit 34.

The cold-water circuit 14 may include the cold-water tank 58, a water-supply conduit 62, a water distributer 64, and the ice mold 54. A cold-water pump 66 may be disposed along the water-supply conduit 62 and may pump water from the cold-water tank 58 through the water-supply conduit 62 to the water distributer 64. The control module 53 (FIG. 4) may be in communication with the cold-water pump 66 and may control operation of the cold-water pump 66, as will be described in more detail below. The water distributer 64 can be a pipe having an inlet (fluidly connected to the water-supply conduit 62) and a plurality of outlet apertures or nozzles 68 (FIG. 3).

Figure 3:
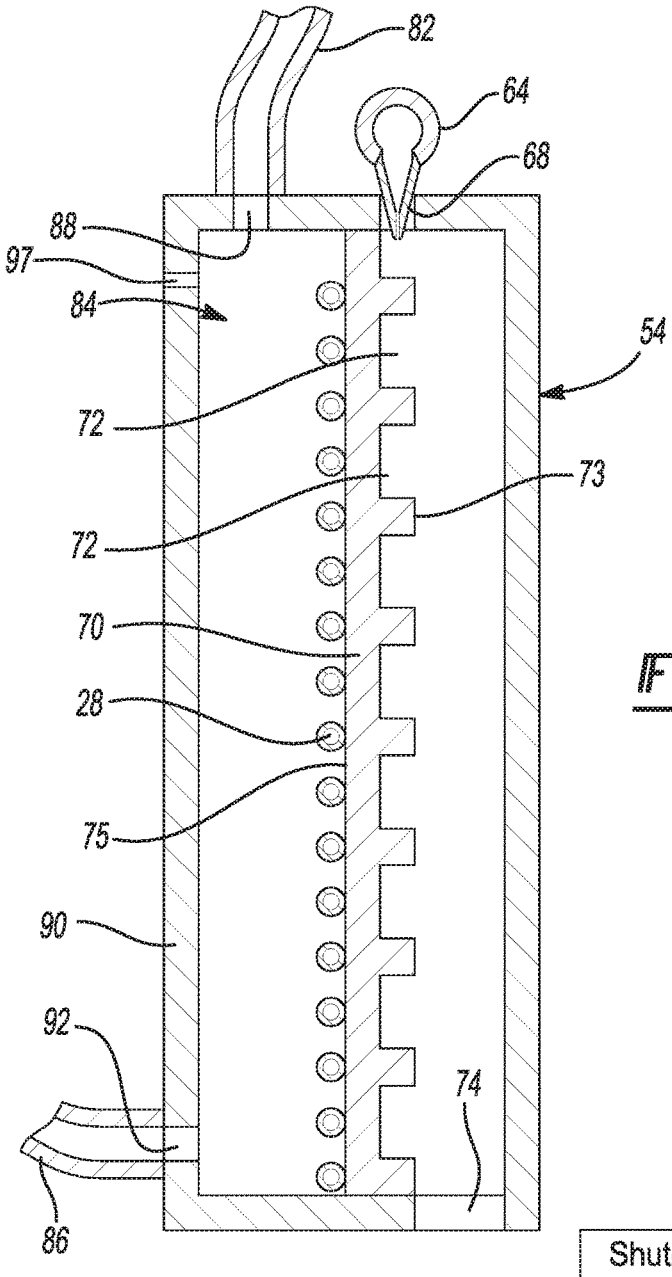
FIG. 3 is a cross-sectional view of an ice mold according to the principles of the present disclosure.
Figure 4:
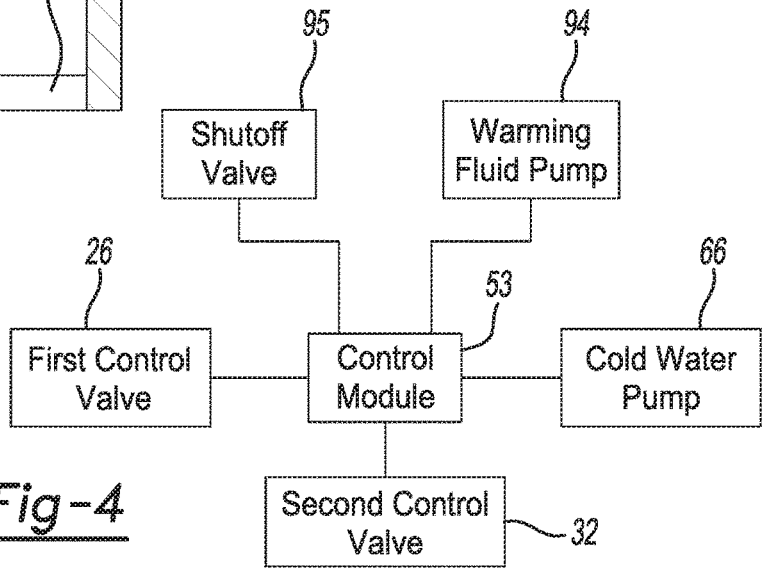
FIG. 4 is a block diagram depicting a control module in communication with valves and pumps.

As shown in FIG. 3, the ice mold 54 may include a grid plate 70 having a plurality of pockets 72 formed in a first side 73 of the grid plate 70. The pockets 72 are shaped to produce a desired shape of ice cube. The ice-making heat exchanger 28 may be embedded in and/or attached to a second opposite side 75 of the grid plate 70. Water from the water distributer 64 may flow out of the outlet apertures or nozzles 68 and into the pockets 72. The ice-making heat exchanger 28 absorbs heat from the water in the pockets 72 to build up ice in the pockets 72. Liquid water that does not accumulate or freeze in the pockets 72 can fall down through an outlet aperture 74 in the ice mold 54 and fall back into the cold-water tank 58.

A filler pipe 76 (FIG. 1) can be fluidly connected with the cold-water tank 58 and a water source 78 (e.g., a city water source or well). A fill valve 80 on the filler pipe 76 can be selectively opened and closed to replenish water in the cold-water tank 58 as appropriate. The control module 53 may be in communication with the fill valve 80 and may control operation of the fill valve 80. The cold-water tank 58 may also include a drain (not shown) and a drain valve (not shown) that allows the water in the cold-water tank 58 to be periodically drained for cleaning and/or maintenance.

The warming-fluid circuit 16 may include the warming-fluid tank 38, a warming-fluid-supply conduit 82, a warming channel 84 (FIG. 3), and a warming-fluid-return conduit 86. The warming-fluid-supply conduit 82 may be fluidly connected to the warming-fluid tank 38 and to one or more inlets 88 (FIG. 3) of the warming channel 84. The warming channel 84 may be defined by the ice mold 54. For example, the warming channel 84 may be formed between the second side 75 of the grid plate 70 and a housing member 90 that may be attached to and/or partially enclosing the grid plate 70. As shown in FIG. 3, the inlet(s) 88 of the warming channel 84 may be formed in or near a top portion of the housing member 90 and one or more outlets 92 of the warming channel 84 may be formed at or near a bottom portion of the housing member 90. The warming-fluid-return conduit 86 may be fluidly coupled with the outlet(s) 92 of the warming channel 84.

A warming-fluid pump 94 may be disposed along the warming-fluid-return conduit 86 and may pump warming fluid from the warming-fluid tank 38 through the warming-fluid-supply conduit 82, through the warming channel 84, and through the warming-fluid-return conduit 86. A shutoff valve 95 may be disposed along the warming-fluid-supply conduit 82 that is movable between an open position allowing fluid flow through the warming-fluid-supply conduit 82 and a closed position preventing fluid flow through the warming-fluid-supply conduit 82. The control module 53 (FIG. 4) may be in communication with the warming-fluid pump 94 and shutoff valve 95 and may control operation of the warming-fluid pump 94 and shutoff valve 95, as will be described in more detail below. As the warming fluid flows through the warming channel 84, heat is transferred from the warming fluid to the grid plate 70 to melt a relatively small portion of ice in the grid plate 70 to allow the ice cubes in the pockets 72 to fall out of the grid plate 70 and into an ice collection bin (not shown).

With continued reference to FIGS. 1-4, operation of the system 10 will be described in detail. When the control module 53 determines that there is a demand for ice cubes (e.g., based on data from one or more sensors in the ice collection bin indicating that an amount of ice cubes in the ice collection bin is below a predetermined amount), the control module 53 may switch the system 10 into the ice-making mode (shown in FIG. 1).

Upon initiating the ice-making mode, the control module 53 may: (i) start up the compressor 18 (or continue operation of the compressor 18 if the system 10 is being switched to the ice-making mode directly from the ice-harvesting mode), (ii) move the first control valve 26 to the first position (i.e., to provide fluid communication between the expansion device 24 and the ice-making heat exchanger 28 and restrict fluid communication between the expansion device 24 and the water-cooling heat exchanger 30), (iii) move the second control valve 32 to the first position (i.e., to provide fluid communication between the ice-making heat exchanger 28 and the suction conduit 34 and restrict fluid communication between the water-cooling heat exchanger 30 and the suction conduit 34), (iv) start up the cold-water pump 66 to provide water flow through the cold-water circuit 14, (v) move the shutoff valve 95 to the closed position (or keep the shutoff valve 95 in the closed position) to prevent warming fluid from flowing from the warming-fluid tank 38 to the channel 84, and (vi) operate (or continue to operate) the warming-fluid pump 94 for a predetermined amount of time following initiation of the ice-making mode to drain the warming fluid from the channel 84, and then shutdown the warming-fluid pump 94. The channel 84 may include a bleed hole 97 (FIG. 3) that is in communication with the ambient environment to prevent negative pressure from building in the channel 84 as the warming-fluid pump 94 purges the warming fluid from the channel 84 following initiation of the ice-making mode.

Therefore, in the ice-making mode, the compressor 18 draws low-pressure working fluid from the suction conduit 34, compresses the working fluid to a higher pressure, and discharges hot, high-pressure working fluid into the discharge conduit 36. From the discharge conduit 36, the hot working fluid flows through the fluid-heating heat exchanger 20 and transfers heat to warming fluid in the warming-fluid tank 38. From the fluid-heating heat exchanger 20, the working fluid flows through the condenser (or gas cooler) heat exchanger 22, where more heat is rejected from the working fluid to ambient air. From the condenser (or gas cooler) heat exchanger 22, the working fluid flows through the expansion device 24 to lower the pressure and temperature of the working fluid. From the expansion device 24, the low-temperature working fluid flows through the first control valve 26 (which is in the first position in the ice-making mode) and into the ice-making heat exchanger 28. Low-temperature working fluid flowing through the ice-making heat exchanger 28 absorbs heat from water that is flowing across and accumulating in pockets 72 of the ice mold 54 to build up ice in the pockets 72. From the ice-making heat exchanger 28, the working fluid may flow through the second control valve 32 (which is in the first position in the ice-making mode) and back to the compressor 18 via the suction conduit 34.

When the control module 53 determines that a predetermined amount of ice has formed in the pockets 72 of the ice mold 54 (e.g., based on data from sensors that detect the thickness or weight of ice in the ice mold 54), the control module 53 may switch the system 10 to the ice-harvesting mode (shown in FIG. 2) to harvest the ice cubes from the ice mold 54 and collect the harvested ice cubes in the ice collection bin.

Upon initiating the ice-harvesting mode, the control module 53 may: (i) continue operation of the compressor 18, (ii) move the first control valve 26 to the second position (i.e., to provide fluid communication between the expansion device 24 and the water-cooling heat exchanger 30 and restrict fluid communication between the expansion device 24 and the ice-making heat exchanger 28), (iii) move the second control valve 32 to the second position (i.e., to provide fluid communication between the water-cooling heat exchanger 30 and the suction conduit 34 and restrict fluid communication between the ice-making heat exchanger 28 and the suction conduit 34), (iv) shut down the cold-water pump 66 to restrict or prevent water flow through the water-supply conduit 62 and the water distributer 64, (v) move the shutoff valve 95 to the open position, and (vi) start up the warming-fluid pump 94 to provide warming-fluid flow through the warming-fluid circuit 16. In some configurations, the warming-fluid pump 94 may operate continuously (or intermittently) during the ice-harvesting mode to pump warming fluid from warming-fluid tank 38 to maintain a continuous flow of warming fluid through the channel 84 during the ice-harvesting mode. In some configurations, the control module 53 may, upon initiation of the ice-harvesting mode, close another shutoff valve (not shown) at the outlet 92 of the channel 84 and operate the warming-fluid pump 94 for a enough time to fill the channel 84 with warming. When the ice-harvesting mode is finished, the control module 53 may open the shutoff valve at the outlet 92 to allow the warming fluid to drain from the channel 84. In some configurations, the channel 84 may be filled and drained multiple times during a single ice-harvesting cycle.

Therefore, in the ice-harvesting mode, the compressor 18 draws low-pressure working fluid from the suction conduit 34, compresses the working fluid to a higher pressure, and discharges hot, high-pressure working fluid into the discharge conduit 36. From the discharge conduit 36, the hot working fluid flows through the fluid-heating heat exchanger 20 and transfers heat to warming fluid in the warming-fluid tank 38. From the fluid-heating heat exchanger 20, the working fluid flows through the condenser (or gas cooler) heat exchanger 22, where more heat is rejected from the working fluid to ambient air. From the condenser (or gas cooler) heat exchanger 22, the working fluid flows through the expansion device 24 to lower the pressure and temperature of the working fluid. From the expansion device 24, the low-temperature working fluid flows through the first control valve 26 (which is in the second position in the ice-harvesting mode) and into the water-cooling heat exchanger 30. Low-temperature working fluid flowing through the water-cooling heat exchanger 30 absorbs heat from water in the cold-water tank 58 to pre-cool the water in the cold-water tank 58 for when the system 10 subsequently operates in the ice-making mode. This pre-cooling of the water in the cold-water tank 58 during the ice-harvesting mode reduces the amount of time and energy that is needed to freeze the water in the ice-making mode. From the water-cooling heat exchanger 30, the working fluid may flow through the second control valve 32 (which is in the second position in the ice-harvesting mode) and back to the compressor 18 via the suction conduit 34.

In the ice-harvesting mode, while the working-fluid circuit 12 is operating to pre-cool the water in the cold-water tank 58, the warming-fluid pump 94 operates to pump warming fluid through the warming-fluid circuit 16 so that warming fluid from the warming-fluid tank 38 flows through the warming channel 84. Heat is transferred from the warming fluid in the warming channel 84 to the grid plate 70. The control module 53 will continue to operate the system 10 in the ice-harvesting mode until enough ice in the grid plate 70 has melted to allow the ice cubes in the pockets 72 to fall out of the ice mold 54 and into the ice collection bin. When the ice cubes fall out of the ice mold 54 and into the collection bin, the control module 53 may determine (e.g., based on data from sensors detecting the presence or absence of ice in the ice mold) that the system 10 can either be shut down or switched back to the ice-making mode if there is a demand for more ice cubes.

Using the warming fluid from the warming-fluid circuit 16 to melt the ice in the ice-harvesting mode (as is done in the system 10 of the present disclosure) may be more energy efficient and more effective than means employed by prior-art ice makers. Typical prior-art ice makers include one or more valves that, in a harvesting mode, redirect hot working fluid discharged from the compressor such that the hot working fluid flows through the same heat exchanger to melt the ice that is used to cool the ice in the ice-making mode. That is, typical prior-art ice makers transfer heat directly from hot discharge gas (e.g., hot gas from the vapor-compression circuit) to the ice mold to melt ice in the harvest mode. By contrast, the system 10 of the present disclosure transfers heat from warming fluid in the warming-fluid circuit 16 to the ice mold 54 to melt the ice. In the system 10 of the present disclosure, the warming fluid in the warming-fluid tank 38 is being continuously heated in both the ice-making mode and in the ice-harvesting mode. In this manner, in the system 10 of the present disclosure, the heat generated by the compression of the working fluid in the ice-making mode is not simply wasted. Rather that heat energy generated during the ice-making mode is used to heat the warming fluid in the warming-fluid tank 38 for use during the ice-harvesting mode.

Furthermore, using the warming fluid in the warming-fluid circuit 16 may be more efficient than the prior-art method described above because the discharge temperatures (i.e., temperature of working fluid discharged from the compressor) during the harvest cycle are typically lower than in the ice-making cycle since the load on the system is typically lower in the harvesting mode.

While the compressor 18 could be a scroll compressor, a reciprocating compressor, a rotary compressor, or any other type of compressor, using a scroll compressor in the system 10 of the present disclosure may be particularly beneficial. Scroll compressors are often more efficient than other types of compressors such as reciprocating compressors. However, scroll compressors often have lower discharge temperatures than other types of compressors, which could reduce the effectiveness of prior-art ice makers that use discharge gas to melt ice in the harvest cycle. On the other hand, the system 10 of the present disclosure uses warming fluid to melt ice in the harvest mode, and the system 10 is continuously heating that warming fluid in both the ice-making and harvesting modes. Therefore, the lower discharge temperature of a scroll compressor may not be as detrimental in the system 10.

An additional advantage of system 10 over prior-art ice makers is that the working-fluid circuit 12 in the system 10 does not reverse direction in the harvesting mode. That is, unlike the system 10, prior-art ice makers actuate one or more valves to allow working fluid from the compressor to bypass the condenser and expansion device such that hot discharge gas from the compressor flows through the evaporator in the harvesting mode. Every time such prior-art ice makers transition between the ice-making and harvesting modes, the compressor is operating in a transient state, which reduces the efficiency of the compressor. By contrast, in the particular example of the working-fluid circuit 12 described above and shown in the figures, the direction of the working fluid flow is the same in both the ice-making and harvesting modes (i.e., the working fluid discharged from the compressor 18 takes the same path to the expansion device in both the ice-making and harvesting modes). Therefore, the compressor 18 of the system 10 can operate in a generally continuous steady-state condition even when the system 10 switches between the ice-making and harvesting modes.

In this application, including the definitions below, the term "module" or the term "control module" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

In this application, apparatus elements described as having particular attributes or performing particular operations are specifically configured to have those particular attributes and perform those particular operations. Specifically, a description of an element to perform an action means that the element is configured to perform the action. The configuration of an element may include programming of the element, such as by encoding instructions on a non-transitory, tangible computer-readable medium associated with the element.

The apparatuses and methods described in this application may be partially or fully implemented by a special purpose computer created by configuring a general purpose computer to execute one or more particular functions embodied in computer programs. The figures and descriptions above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

None of the elements recited in the claims are intended to be a means-plus-function element within the meaning of 35 U.S.C. § 112 (f) unless an element is expressly recited using the phrase "means for," or in the case of a method claim using the phrases "operation for" or "step for."

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A system operable in an ice-making mode and in an ice-harvesting mode, the system comprising:

a working-fluid circuit through which a working fluid flows, the working-fluid circuit including a compressor, an expansion device, and an ice-making heat exchanger, wherein the expansion device is disposed downstream of the compressor, wherein the ice-making heat exchanger is disposed between the expansion device and the compressor along the working-fluid circuit;

an ice mold configured to receive water from a water-supply conduit when the system is operating in the ice-making mode, wherein the ice mold is in a heat-transfer relationship with the ice-making heat exchanger; and a warming-fluid circuit including a warming-fluid tank, a warming-fluid-supply conduit, and a warming-fluid-return conduit, wherein the ice mold defines a channel configured to receive a warming fluid from the warming-fluid-supply conduit when the system is operating in the ice-harvesting mode, wherein the warming fluid from the warming-fluid-supply conduit has a higher temperature than the water from the water-supply conduit, and wherein the warming fluid is fluidly isolated from the working fluid that circulates through the working-fluid circuit, wherein the warming-fluid-supply tank is fluid coupled to the warming-fluid tank and the channel defined by the ice mold such that: (i) the warming-fluid tank supplies the warming fluid to the warming-fluid-supply conduit and (ii) the warming-fluid-supply conduit supplies the warming fluid to the channel, and wherein the warming-fluid-return conduit is fluidly coupled to the warming-fluid tank and the channel defined by the ice mold such that: (i) the warming-fluid-return conduit receives the warming fluid from the channel and (ii) the warming-fluid-return conduit provides the warming fluid from the channel to the warming-fluid tank.

2. The system of claim 1, wherein the working-fluid circuit includes a fluid-heating heat exchanger in a heat-transfer relationship with the warming fluid in the warming-fluid tank, wherein the fluid-heating heat exchanger is in fluid communication with the compressor such that working fluid discharged from the compressor is received in the fluid-heating heat exchanger prior to flowing to the expansion device.

3. The system of claim 2, wherein the fluid-heating heat exchanger is disposed inside of the warming-fluid tank.

4. The system of claim 2, further comprising:

a pump that pumps warming fluid from the warming-fluid tank through the warming-fluid-supply conduit, the channel and the warming-fluid-return conduit; and a control module configured to operate the pump in the ice-harvesting mode and shutdown the pump in the ice-making mode.

5. The system of claim 2, wherein the working fluid discharged from the compressor is received in the fluid-heating heat exchanger in the ice-harvesting mode and in the ice-making mode.

6. The system of claim 5, wherein the working-fluid circuit includes a heat exchanger that is spaced apart from the warming-fluid tank and is in fluid communication with the fluid-heating heat exchanger and the expansion device such that the heat exchanger receives working fluid from the fluid-heating heat exchanger and provides working fluid to the expansion device.

7. The system of claim 1, further comprising a cold-water tank in fluid communication with the water-supply conduit, wherein the working-fluid circuit includes a water-cooling heat exchanger in a heat-transfer relationship with the cold-water tank, wherein the water-cooling heat exchanger is in fluid communication with the expansion device such that working fluid from the expansion device is received in the water-cooling heat exchanger prior to flowing to the compressor.

8. The system of claim 7, wherein the water-cooling heat exchanger is disposed inside of the cold-water tank.

9. The system of claim 7, wherein the working-fluid circuit includes a valve in fluid communication with the expansion device, the ice-making heat exchanger and the water-cooling heat exchanger, and wherein the valve is movable between a first position in which the valve allows fluid flow from the expansion device to the ice-making heat exchanger and restricts fluid flow from the expansion device to the water-cooling heat exchanger and a second position in which the valve allows fluid flow from the expansion device to the water-cooling heat exchanger and restricts fluid flow from the expansion device to the ice-making heat exchanger.

10. The system of claim 9, wherein the valve is in the first position when the system is in the ice-making mode, and wherein the valve is in the second position when the system is in the ice-harvesting mode.

11. The system of claim 1, wherein the compressor is a scroll compressor.

12. The system of claim 1, wherein the warming fluid is water.

13. The system of claim 1, wherein the warming fluid is water with an additive that raises a boiling point of the warming fluid to a temperature higher than the boiling point of water.

14. A system operable in an ice-making mode and in an ice-harvesting mode, the system comprising:

a working-fluid circuit through which a working fluid flows, the working-fluid circuit including a compressor, an expansion device, and an ice-making heat exchanger, wherein the expansion device is disposed downstream of the compressor, wherein the ice-making heat exchanger is disposed between the expansion device and the compressor along the working-fluid circuit;

an ice mold configured to receive water from a water-supply conduit when the system is operating in the ice-making mode, wherein the ice mold is in a heat-transfer relationship with the ice-making heat exchanger; and a cold-water tank in fluid communication with the water-supply conduit, the working-fluid circuit including a water-cooling heat exchanger in a heat-transfer relationship with the cold-water tank, wherein the water-cooling heat exchanger is in fluid communication with the expansion device such that working fluid from the expansion device is received in the water-cooling heat exchanger prior to flowing to the compressor.

15. The system of claim 14, wherein the ice mold defines a channel configured to receive a warming fluid from a warming-fluid-supply conduit while the system is operating in the ice-harvesting mode, wherein the warming fluid from the warming-fluid-supply conduit has a higher temperature than the water from the water-supply conduit, and wherein the warming fluid is fluidly isolated from the working fluid that circulates through the working-fluid circuit.

16. The system of claim 15, wherein the warming fluid is water.

17. The system of claim 15, wherein the warming fluid is water with an additive that raises a boiling point of the warming fluid to a temperature higher than the boiling point of water.

18. The system of claim 15, further comprising:

a warming-fluid tank in fluid communication with the warming-fluid-supply conduit; and a warming-fluid-return conduit in fluid communication with the channel and the warming-fluid tank.

19. The system of claim 18, wherein the working-fluid circuit includes a fluid-heating heat exchanger in a heat-transfer relationship with the warming fluid in the warming-fluid tank, wherein the fluid-heating heat exchanger is in fluid communication with the compressor such that working fluid discharged from the compressor is received in the fluid-heating heat exchanger prior to flowing to the expansion device.

20. The system of claim 19, wherein the fluid-heating heat exchanger is disposed inside of the warming-fluid tank.

21. The system of claim 19, wherein the working fluid discharged from the compressor is received in the fluid-heating heat exchanger in the ice-harvesting mode and in the ice-making mode.

22. The system of claim 21, wherein the working-fluid circuit includes a heat exchanger that is spaced apart from the warming-fluid tank and is in fluid communication with the fluid-heating heat exchanger and the expansion device such that the heat exchanger receives working fluid from the fluid-heating heat exchanger and provides working fluid to the expansion device.

23. The system of claim 19, further comprising:

a warming-fluid pump that pumps warming fluid from the warming-fluid tank through the warming-fluid-supply conduit, the channel and the warming-fluid-return conduit; and a control module configured to operate the warming-fluid pump in the ice-harvesting mode and shutdown the warming-fluid pump in the ice-making mode.

24. The system of claim 23, wherein the working-fluid circuit includes a valve in fluid communication with the expansion device, the ice-making heat exchanger and the water-cooling heat exchanger, and wherein the valve is movable between a first position in which the valve allows fluid flow from the expansion device to the ice-making heat exchanger and restricts fluid flow from the expansion device to the water-cooling heat exchanger and a second position in which the valve allows fluid flow from the expansion device to the water-cooling heat exchanger and restricts fluid flow from the expansion device to the ice-making heat exchanger.

25. The system of claim 24, wherein the valve is in the first position when the system is in the ice-making mode, and wherein the valve is in the second position when the system is in the ice-harvesting mode.

26. The system of claim 14, wherein the water-cooling heat exchanger is disposed inside of the cold-water tank.

27. The system of claim 14, wherein the compressor is a scroll compressor.

* * * * *